United States Patent [19]

Smith

[11] 3,994,245

[45] Nov. 30, 1976

[54] TIGHT END CIRCUITRY II

[75] Inventor: Randel Pembroke Smith, Chattanooga, Tenn.

[73] Assignee: The Singer Company, Elizabeth, N.J.

[22] Filed: Apr. 15, 1976

[21] Appl. No.: 677,104

[52] U.S. Cl. ..... 112/79 R; 112/218 R; 112/219 R; 200/61.18

[51] Int. Cl.[2] ..... D05C 15/18

[58] Field of Search ..... 112/218 R, 219 R, 79 R; 200/61.18, 61.13

[56] References Cited

UNITED STATES PATENTS

| | | | |
|---|---|---|---|
| 3,009,433 | 11/1961 | Kuhn | 112/219 R |
| 3,221,682 | 12/1965 | Bernell | 112/79 R |
| 3,221,683 | 12/1965 | Abelsma | 112/79 R |
| 3,764,773 | 10/1973 | Merkle | 200/61.18 |
| 3,783,811 | 1/1974 | Schmedding et al. | 112/218 R |

*Primary Examiner*—H. Hampton Hunter
*Attorney, Agent, or Firm*—Edward L. Bell; Robert E. Smith; Alan Ruderman

[57] ABSTRACT

A multiple needle tufting machine having a multiplicity of yarns and a high tension detector for detecting when the tension of any yarn between the tufting machine and a yarn supply deviates from a predetermined normal and for identifying the particular yarn that so deviates. The detector includes a yarn contacting member for each yarn urged into engagement with the yarn for reacting to tension variation and to close a switch when the tension is excessive. Two electrical circuits for identifying the particular switch, and therefore yarn, are disclosed.

4 Claims, 4 Drawing Figures

TIGHT END CIRCUITRY II

BACKGROUND OF THE INVENTION

This invention relates to multi yarn machinery for producing fabric such as tufting machines and more particularly to the detecting of high tension in the individual yarn and identifying the yarn in which the high tension exists.

In yarn working machines such as tufting machines the existence of excessively high yarn tension will either break the yarn or produce a product which is defective. Various yarn detecting devices which stop the machine in case of yarn breakage or excessive tension are known in the art.

Tufting machines such as those used to produce tufted carpet may employ upward of 1,000 needles mounted for vertical reciprocation, each of which needles carries a separate individual yarn into cooperative relationship with a looper to produce the tufted pile. Due to various conditions such as creel snarl-ups, that is yarn snarling as it pulls off the creel cones, excessive tension in one or a few yarns may occur. The resulting defective carpeting produced may be quite expensive since detection may not occur until many yards of fabric have been produced. The prior art detectors such as those illustrated in U.S. Pat. Nos. 3,221,682; 3,221,683 and 3,764,773 have been directed toward devices which will detect the type yarn end and stop the machine so as to minimize the waste. These detectors do not however determine which particular yarn end has the excessive amount of tension. Thus the operator must search back to the creel to determine the troublesome yarn end. With a full size tufting machine having over 1,000 yarns this can be quite a difficult and time consuming operation.

SUMMARY OF THE INVENTION

It is therefore a primary object of the present invention to provide a detector for multi yarn textile machines that detects above-normal tension in the yarn fed to the machine and which can identify the particular yarn in which the tension is excessive.

It is another object of the present invention to provide a high tension detector which senses excessive tension in the yarn fed to a tufting machine and which can identify the particular yarn having the excessive tension.

It is a further object of the present invention to provide a yarn tension detector for a tufting machine which will indicate which of the multiplicity of yarns has excessive tension deviation from a predetermined value.

Accordingly, the present invention provides a tension detector which senses excessive tension deviation in the yarn to operate a loaded plunger. There is a separate plunger for each yarn end with each plunger operating to complete an electric circuit when the plunger is acted upon by a high tension deviation yarn. In one embodiment the electrical circuit consists of a bank of identical resistors connected in series, a switch corresponding to each resistor mounted between the respective resistor and an electrical measuring instrument to by-pass the subsequent resistors to a known source of electricity. The switches are closed by the actuation of a respective one of the plungers. The electrical measuring instrument can be calibrated to display the particular yarn or needle number directly thereon so that the operator may identify the particular troublesome yarn. In this embodiment no power from the source is drawn unless a switch is closed. In a second embodiment the circuit includes a bank of resistors connected in series with an electrical measuring instrument and a known source of electricity, and a switch corresponding to each resistor to by-pass the remaining resistors when closed.

BRIEF DESCRIPTION OF THE DRAWINGS

Other objects and advantages of this invention will best be understood upon reading the following detailed description of the invention with the accompanying drawings, in which.

DETAILED DESCRIPTION OF THE PREFERRED EMBODIMENT

Figure 1:
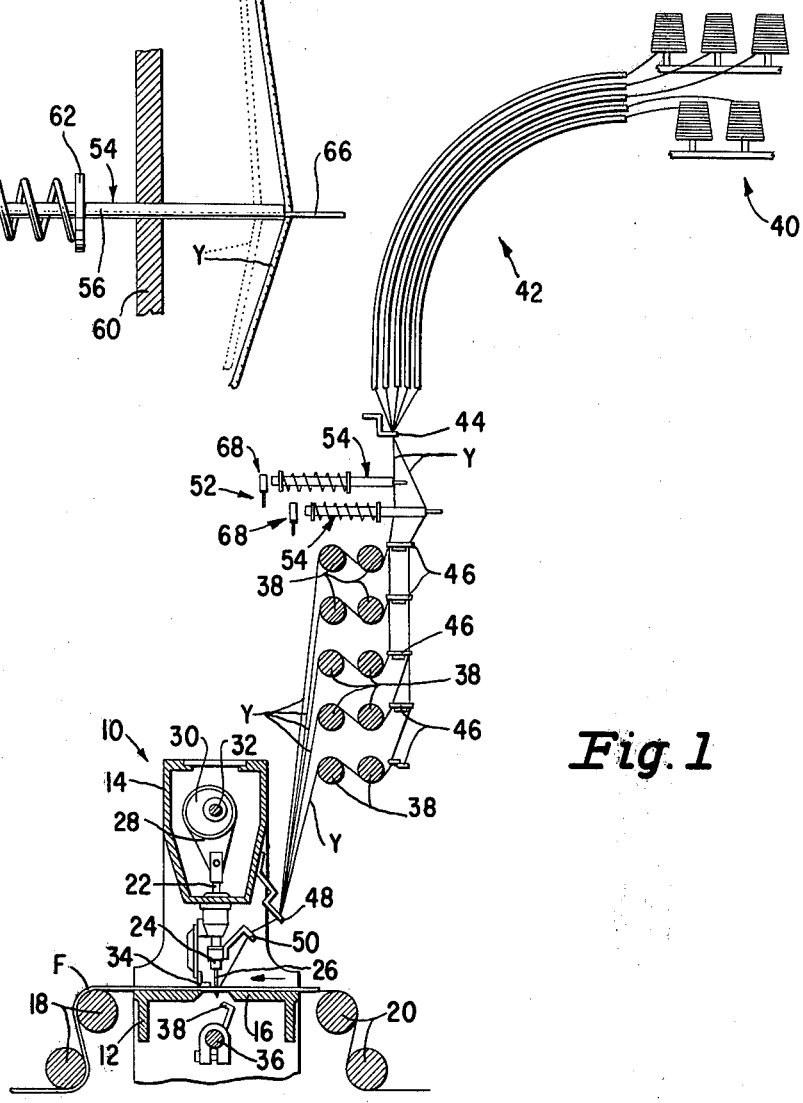
FIG. 1 is a transverse schematic section through a multi-needle tufting machine and a pattern attachment including a yarn tension detector constructed in accordance with the present invention.

Referring now to the drawings, there is illustrated in FIG. 1 a tufting machine 10 having a frame comprising a bed 12 and a head 14 disposed above the bed 12. The bed 12 includes a bed plate 16 across which a fabric F is adapted to be fed by a pair of feed rolls 18 and take-off rolls 20.

Mounted in the head 14 for vertical reciprocation is one of a plurality of push rods 22 to the lower end of which a needle bar 24 is carried and which in turn carries a plurality of needles 26 that are adapted to penetrate the fabric F on the bed plate 16 upon reciprocation of the needle bar 24 to project loops of yarn therethrough. Endwise reciprocation is imparted to the push rods 22 and thus the needle bar 24 and needles 26 by a link 28 which is pivotably connected at its lower end to the push rods 22 and at its upper end to an eccentric 30 on a driven rotary main shaft 32 that is journalled longitudinally in the head 14. A presser foot assembly 34 may be supported on the head 14 to hold down the fabric F during needle retraction.

Beneath the bed plate 16 there is journalled an oscillating looper shaft 36 which is arranged parallel to the main shaft 32 and which carries a plurality of loopers 38. Each looper 38 cooperates with a needle 26 to seize a loop of yarn presented thereby and holds the same as the needle is withdrawn on its return stroke, after which the looper retracts to release the loop. While, to simplify the disclosure, only a single needle 26 and single looper 38 is shown, it is understood that a multiplicity of such elements are normally provided laterally across the machine, and that the number may be upwards of 1,000 of each such elements.

Yarn Y may be fed to the needles 26 by a pattern attachment including a yarn feed roller assembly having a multiplicity of rollers 38 which may be mounted on or above the head of the tufting machine as illustrated. Yarn is drawn by the feed rolls 38 from a creel 40 through a plurality of creel tubes 42 passing through a stationary yarn guide 44 positioned below the outlet of the creel tubes and extend through a plurality of stationary yarn guides preferably one for each pair of feed rollers 38. The amount of yarn supplied to the needles of the tufting machine is determined by the rotational speed of the feed rollers on which the yarn strands are wound. To create pattern pile effects the amount of yarn fed to the individual needles may be varied by driving the feed rolls selectively at different speeds as determined by a pattern control mechanism which is not shown, but which is known in the art. From the feed rolls the yarn passes through a stationary yarn guide 48 fixed on the head 14 of the machine and from there to a yarn jerker bar 50 secured to the needle bar 24 so as to move therewith. There may be one pair of feed rollers for each yarn strand, that is for each needle, but preferably as used in the prior art the number of feed rollers are less than the number of yarns so that the number of yarns are generally divided evenly over the number of feed rollers thereby determining the number of pattern repeats produced in the backing fabric across the width of the machine. It is immaterial to the present invention as to the number of pattern rolls since the present invention is applicable to the number of yarn strands fed to the needles.

Figure 2:
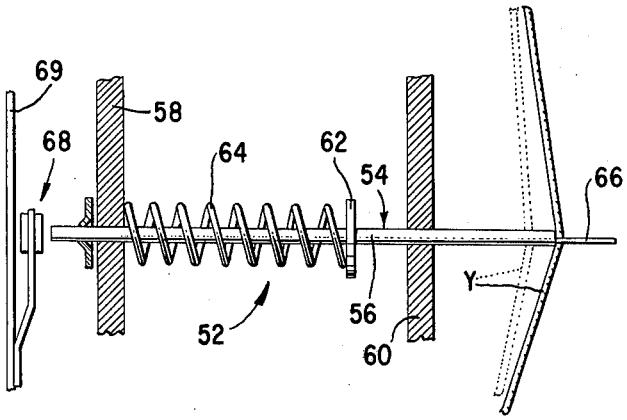
FIG. 2 is an enlarged schematic section of one tension detector illustrated in FIG. 1.

The tight end detectors indicated generally as 52 are positioned preferably between the yarn feed rollers and the creel and as illustrated may be positioned between the creel tubes and the feed rollers, there preferably being one such detector for each yarn end. Each detector as best illustrated in FIG. 2 comprises a plunger 54 having a rod 56 axially journalled between a pair of brackets 58 and 60. Positioned on the rod 56 intermediate the brackets 58 and 60 is a disk or stop member 62 which is secured to the rod 56. Positioned about the rod 56 between the disk member 62 and the bracket 58 is a coil spring 64 which urges the rod outwardly toward the yarn strands Y. At the free end of the rod 56 is an eyelet 66 through which one strand of yarn Y is guided in its path between the stationary yarn guide 44 and the stationary yarn guides 46. Facing the opposite end of the rod 56 which extends outwardly of the bracket 58 is a switch contact 68 preferably resiliently mounted on a printed circuit board 69 including cooperating contacts and electrical circuitry. It should be understood that there is preferably one such contact for each yarn strand in the machine. When above normal tension occurs in a particular strand of yarn the tightening of yarn acts against the loaded plunger to force the plunger to engage the corresponding switch contact 68 to act against the circuit board 69 thereby completing an electrical circuit.

Figure 3:
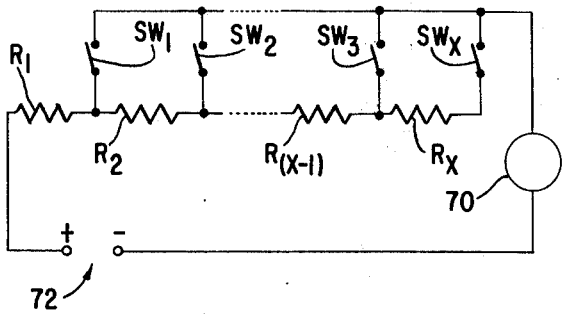
FIG. 3 is a schematic drawing of the electrical circuit for a first embodiment of the yarn detector of the present invention.

The electrical circuit of the first preferred embodiment, as illustrated in FIG. 3, consists of a bank of identical resistors identified as $R_1$, $R_2$ etc. . . . $R_X$ which are connected in series. The switch contacts 68 are connected into the circuits such that there is one switch $SW_1$, $SW_2$ . . . $SW_X$ after each resistor $R_1$, $R_2$ . . . $R_X$ which upon closing shorts or by-passes the subsequent resistors. A current measuring device such as ammeter 70 is placed in series with a source of electricity, preferably a d.c. source 72, and with the resistive combination of the resistors and switches so that when a switch is closed the ammeter is placed in series with the power supply, the closed switch and the resistors before that switch. The remaining resistors after the closed switch being by-passed. The ammeter therefore measures current through the resistors prior to the closed switch, and can be so calibrated to indicate or identify the particular switch or yarn member directly thereon so the operator can identify the troublesome yarn.

With this arrangement when a switch is closed by the action of the plunger 54 the current through the resistors preceeding that switch is displayed on the ammeter 70. Current does not flow unless a switch is closed. For example, assuming there are 1,000 needles and yarns and a known voltage of 100 volts is applied to one ohm resistors the current read by the meter 70 is determined by Ohms Law and is therefore determined by the number of resistors preceeding the closed switch. Thus, each switch is indicated by a particular reading and the meter can be so calibrated. In this example closing switch $SW_1$ would record 100 amps, closing switch $SW_X$ would record 0.1 amp. The ammeter can therefore be calibrated accordingly. Thus, when the tension in a particular yarn becomes too great thereby closing a switch the current through the resistors could be read directly on the ammeter as a particular yarn number. The operator would thereby know which yarn creel or tube to proceed to in order to correct the fault. Of course provision could be made for the machine to be automatically stopped upon the indication of a tight end, but the operator would now know immediately which yarn end was the faulty end and could correct the problem.

Figure 4:
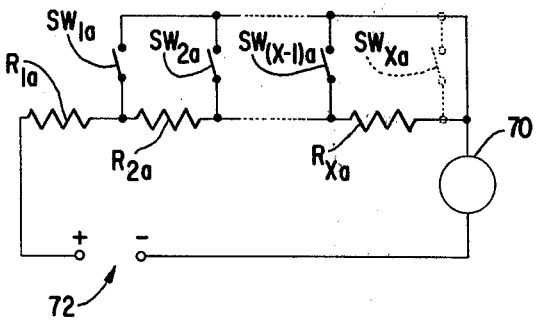
FIG. 4 is a schematic drawing of the electrical circuit for a second embodiment of the yarn detector of the present invention.

In the second embodiment, that of FIG. 4, all the resistors $R_{1a}$, $R_{2a}$ etc. . . . $R_{Xa}$ are connected in series with the ammeter 70 and the source 72. A switch $SW_{1a}$, $SW_{2a}$ . . . $SW_{Xa}$ is mounted after each resistor which upon closing shorts or by-passes the subsequent resistors. In practice there is no need to include a switch after resistor $R_{Xa}$ with this configuration since this switch would merely short a conductor to the ammeter, it has therefore been illustrated in phantom. When a switch is closed upon actuation of plunger 54 the current normally flowing through all the resistors to the ammeter is shorted or by-passed around the resistors subsequent to the switch. Thus, the current value is altered and the ammeter can be calibrated accordingly to indicate the closed switch. In this embodiment current is always flowing through the ammeter, but its value changes when it is closed.

Numerous alterations of the structure herein disclosed will suggest themselves to those skilled in the art. However, it is to be understood that the present disclosure relates to a preferred embodiment of the invention which is for purposes of illustration only and not to be construed as a limitation of the invention. All such modifications which do not depart from the spirit of the invention are intended to be included within the scope of the appended claims.

Having thus described the nature of the invention, what we claim herein is:

1. In a multiple needle pile forming machine having a multiplicity of yarns fed from a yarn supply to the machine to be received and manipulated by respective needles of the machine, apparatus for detecting when the yarn tension between the yarn supply and the machine deviates from a predetermined normal range and for identifying the particular yarn which so deviates, said apparatus comprising tension sensitive means having a yarn contacting member for each yarn positionally responsive to yarn tension, and electrical circuitry including electrical switch means corresponding to each yarn contacting member and actuated thereby for changing the electrical state when the tension of the respective yarn deviates from a predetermined value, an electrical resistance member corresponding to each switch means, said resistance members being connected in a series, a source of electricity, and a current measuring instrument connected in series with said source for measuring all the current flowing through said circuitry, each switch having an electrically common contact connected to a first terminal of said instrument, a second contact of each switch being connected in parallel fashion adjacent a corresponding resistor, and means connecting said source of electricity to a second terminal of said instrument, whereby tension deviation of a yarn from a predetermined normal value changes the relationship between the contacts of the corresponding switch means to thereby change the state of the switch and the measurement indicated by said instrument.

2. In a multiple needle pile forming machine as recited in claim 1 wherein the contacts of said switches are normally open and upon closing of a particular switch the source of electricity, the instrument, the particular switch and the resistance members in the circuit before said switch are electrically connected in series.

3. In a multiple needle pile forming machine as recited in claim 2 wherein an open circuit exists and no electricity flows in the circuitry until at least one switch is closed, whereupon an electrical path is completed.

4. In a multiple needle pile forming machine as recited in claim 2 wherein a closed electrical path exists in both the open and closed conditions of said switches.

* * * * *